United States Patent [19]

Winberg et al.

[11] Patent Number: 4,773,215

[45] Date of Patent: Sep. 27, 1988

[54] EXHAUST CONTROL ASSEMBLY FOR MARINE STERN DRIVE

[75] Inventors: Arvid E. Winberg, Fond du Lac; John J. Litjens, Omro, both of Wis.

[73] Assignee: Brunswick Corporation, Skokie, Ill.

[21] Appl. No.: 942,609

[22] Filed: Dec. 17, 1986

[51] Int. Cl.[4] ..... B63H 21/32

[52] U.S. Cl. ..... 60/324; 440/89

[58] Field of Search ..... 440/89; 60/324, 288

[56] References Cited

U.S. PATENT DOCUMENTS

| | | | |
|---|---|---|---|
| 2,488,563 | 11/1949 | Sills | 60/324 |
| 3,487,804 | 1/1970 | Kiekhaefer | 440/66 |
| 3,552,121 | 1/1971 | Kitigawa . | |
| 3,576,172 | 4/1971 | Ward . | |
| 4,178,873 | 12/1979 | Bankstahl . | |
| 4,504,238 | 5/1985 | Neisen . | |
| 4,573,318 | 3/1986 | Entringer et al. . | |
| 4,601,666 | 7/1986 | Wood . | |
| 4,643,272 | 2/1987 | Gaffrig | 181/272 |

FOREIGN PATENT DOCUMENTS

| | | | |
|---|---|---|---|
| 432443 | 10/1911 | France . | |
| 295488 | 4/1932 | Italy | 60/324 |
| 2141784 | 1/1985 | United Kingdom . | |

OTHER PUBLICATIONS

KAAMA Power Systems Catalog and Installation Instructions, KAAMA Marine Enginerring, Inc., 936 Sunset Drive, Costa Mesa, CA 92627 (714) 642-5021.

Keikhaefer Aeromarine Catalog for Exhaust Systems dated 2/86, Kiekhaefer Aeromarine, 1970 Aeromarine Drive, P.O. Box 1458, Fond du Lac, Wisconsin 54935 (414) 921-5330.

*Primary Examiner*—Douglas Hart

*Attorney, Agent, or Firm*—Andrus, Sceales, Starke & Sawall

[57] ABSTRACT

A stern drive marine propulsion system (2) has an inboard engine (4) with an exhaust (6), an outboard drive unit (8) operatively coupled to the engine (4) and separated therefrom by a transom (10) having two exhaust passages (28 and 34) therethrough, and an exhaust control assembly (16) aft of the engine exhaust (6) and forward of the transom (10) and within the boat (12). The assembly (16) has an inlet (18) connected to the engine exhaust (6), and has first and second outlets (22 and 24) communicating with the respective exhaust passages (28 and 34) extending aft through the transom (10). A valve (26) in the assembly (16) selectively controls communication of the inlet (18) with the first outlet (22).

10 Claims, 2 Drawing Sheets

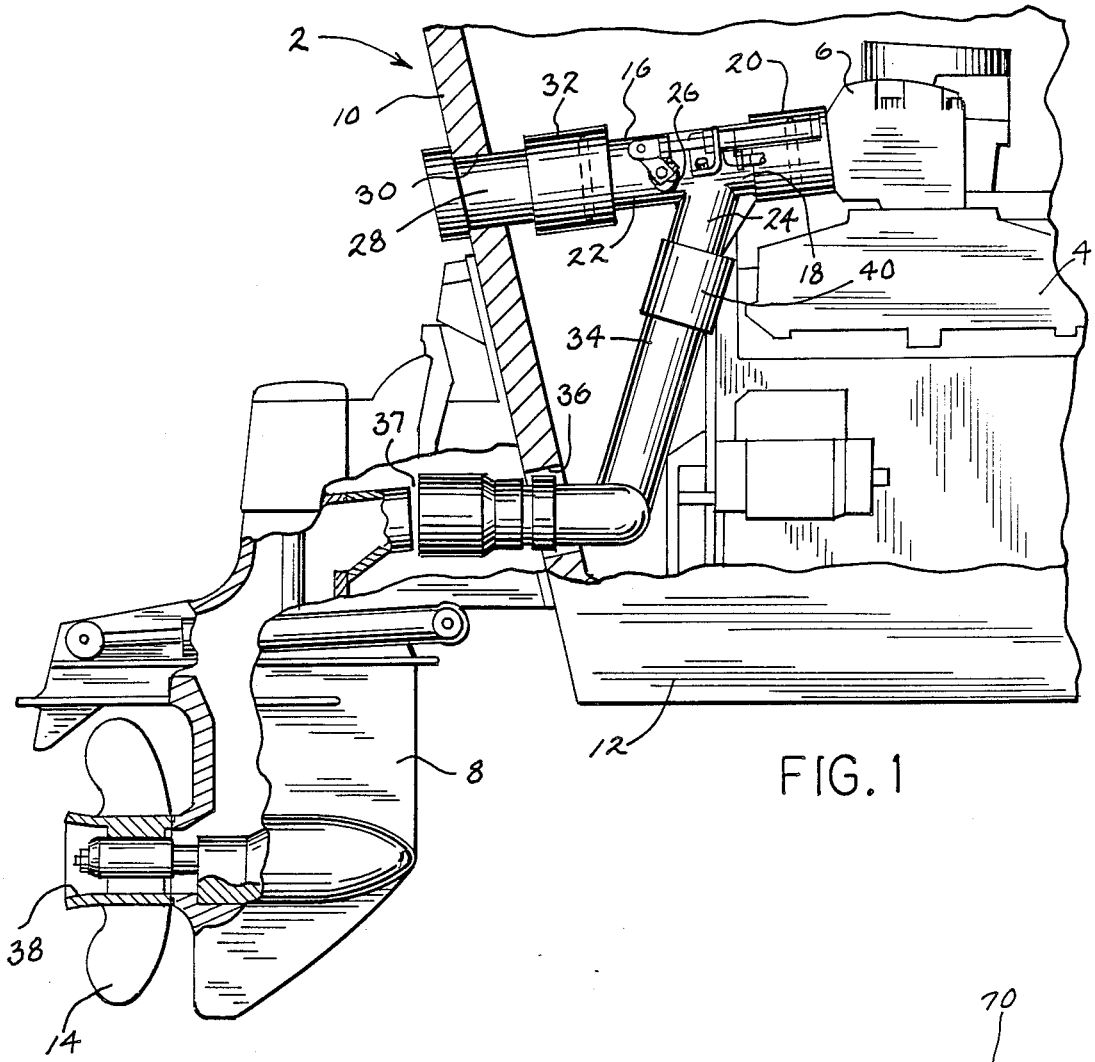
FIG. 1
FIG. 5
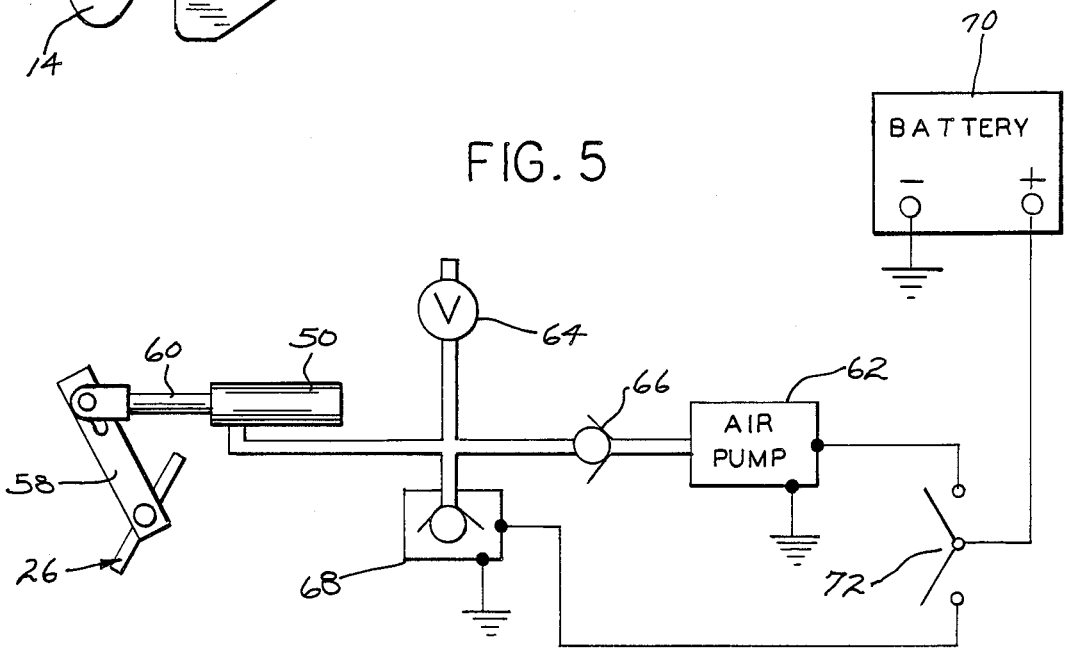

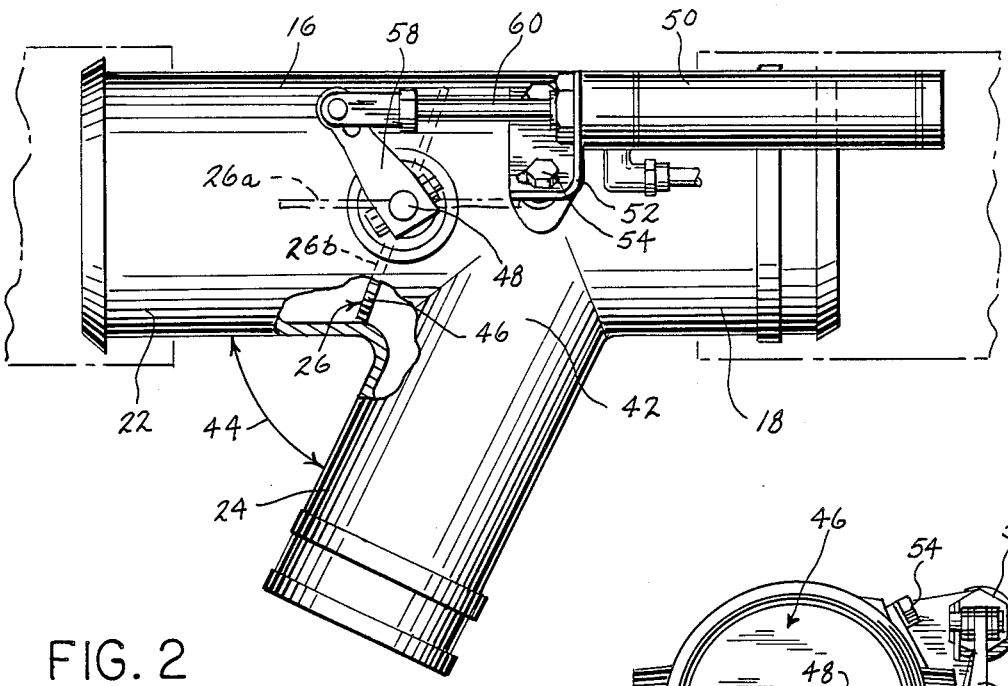
FIG. 2
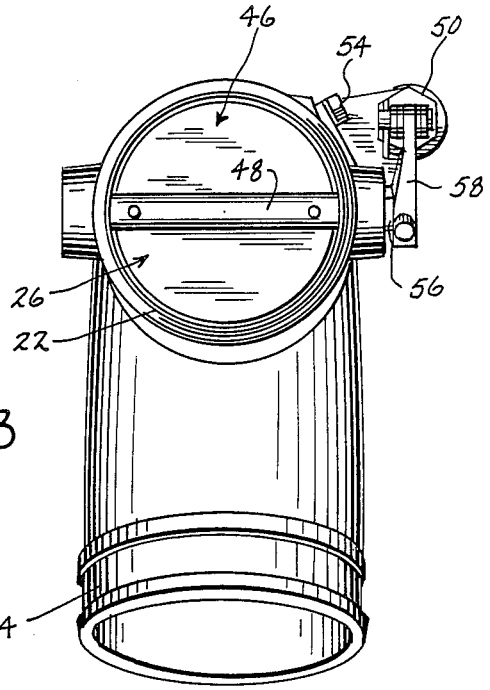
FIG. 3
FIG. 4
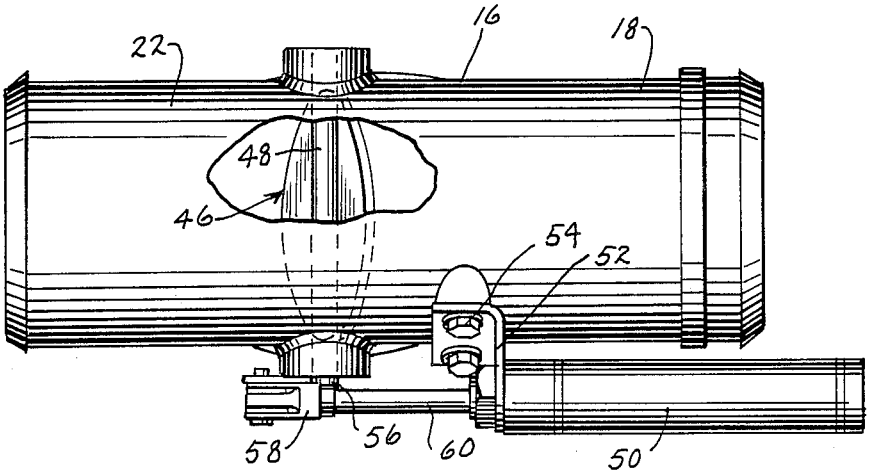

EXHAUST CONTROL ASSEMBLY FOR MARINE STERN DRIVE

BACKGROUND AND SUMMARY

The invention relates to an exhaust system for a stern drive marine propulsion system.

The transom of the boat has two exhaust passages therethrough. The exhaust control assembly is forward of the transom and within the boat. The exhaust control assembly has a valve selectively controllable by the operator to control engine exhaust between different outlets, from which the exhaust passages extend aft through the transom. The system enables less stringent mounting and integrity requirements, and also enables accurate precalibration of the valve independently of position and orientation relative to the transom.

BRIEF DESCRIPTION OF THE DRAWINGS

FIG. 1 is a view of a stern drive marine propulsion system with an exhaust assembly in accordance with the invention.

FIG. 2 is a side elevation view of the exhaust assembly of FIG. 1.

FIG. 3 is an end view of the assembly of FIG. 2.

FIG. 4 is a top view of the assembly of FIG. 2.

FIG. 5 is a schematic circuit diagram of the control circuitry for the valve in the exhaust assembly of FIG. 1.

DETAILED DESCRIPTION

FIG. 1 shows a stern drive marine propulsion system 2 having an inboard engine 4 with an exhaust at exhaust elbow 6, and having an outboard drive unit 8 operatively coupled to the engine and separated therefrom by transom 10 of boat 12. Engine 4 is drivingly connected to propeller 14 for propelling boat 12. Exhaust elbow 6 is shown and described in U.S. Pat. No. 4,573,318, incorporated herein by reference.

Exhaust control assembly 16 is aft of engine exhaust elbow 6 and forward of transom 10. Assembly 16 has an inlet 18 connected to exhaust elbow 6 by a tubular rubber or the like sleeve 20 fitting snugly around inlet 18 and the outlet of exhaust elbow 6. Assembly 16 has first and second outlets 22 and 24. Valve 26 selectively controls communication of inlet 18 with outlet 22. Outlet 22 is connected to exhaust passage pipe 28 extending aft through a first aperture 30 in transom 10. Outlet 22 is connected to pipe 28 by tubular rubber or the like sleeve 32 fitting snugly therearound. Outlet 24 is connected to exhaust passage pipe 34 extending aft through a second aperture 36 in transom 10 as shown in Bankstahl U.S. Pat. No. 4,178,873, incorporated herein by reference. As an alternative to slip joint 37, a bellows connection may be used. The exhaust passage through pipe 34 extends through outboard drive unit 8 and propeller 14 as shown at discharge passage 38. Outlet 24 is connected to exhaust passage pipe 34 by tubular rubber or the like sleeve 40 fitting snugly therearound.

Valve 26 is in outlet 22 and has a first condition as shown at 26*a*, FIG. 2, providing communication of inlet 18 with outlet 22, and has a second condition as shown at 26*b* blocking communication of inlet 18 with outlet 22. Inlet 18 and outlet 22 form a straight-through passage. Outlet 24 extends from the interface 42 of inlet 18 and outlet 22 at an angle 44 to the straight-through passage, to define a bent passage from inlet 18 to outlet 24. Valve 26 is a butterfly valve at the entrance to outlet 22, and is provided by a plate-like disc 46 mounted on a shaft 48 extending through the interior of the assembly and pivotally mounted to the sidewalls thereof. In the first open position 26*a*, disk 46 of the butterfly valve is parallel to the straight-through passage and provides communication of inlet 18 with outlet 22. In the second closed position 26*b*, disk 46 of the butterfly valve is substantially parallel to the passage through outlet 24 and provides the bend in the bent passage and deflects exhaust from inlet 18 to outlet 24. Water-proof and exhaust-proof gaskets (not shown) are provided between the shaft and the sidewalls of the assembly to seal the shaft and prevent leakage therepast.

A pneumatic actuator is provided by an air cylinder 50 mounted by bracket 52 and bolts 54 to assembly 16, and is on the same side of transom 10 as assembly 16. End 56, FIGS. 3 and 4, of shaft 48 extends exteriorly of assembly 16 and is connected by linkage 58 to extensible and retractable piston 60 of air cylinder 50, such that linkage 58 pivots shaft 48 in response to extension and retraction of piston 60 to operate valve 26 between open condition 26*a* and closed condition 26*b*.

Air cylinder 50 is mounted to assembly 16 independently of transom 10. Assembly 16, valve 26 and air cylinder 50 are all forward of transom 10. The condition of valve 26 is calibrated according to position and orientation of air cylinder 50 on assembly 16 independently of position and orientation relative to transom 10.

FIG. 5 shows control circuitry for valve 26. Air cylinder 50 is a Parker fluid power Part No. 1.06RSRY02.0EV. Air cylinder 50 is internally spring biased such that piston 60 is normally extended, and hence butterfly valve 26 is normally in the closed position 26*b*. An air pump 62 is provided for supplying pressurized air to air cylinder 50. Air pump 62 is a Thomas Industries compressor Part No. 405ADC38/12. A regulator valve 64 is provided for regulating the pressure supplied by air pump 62 to air cylinder 50, to prevent overpressuring and damaging the system. Regulator valve 64 is a Circle Seal Controls relief valve Part No. 532IM30. A one-way check valve 66 is provided between air pump 62 and air cylinder 50 blocking back-pressure from air cylinder 50 to air pump 62, to prevent the system from leaking and changing the valve position. Check valve 66 is a Circle Seal Controls check valve Part No. 2232B-IMM. A relief valve 68 is provided for affirmatively depressurizing the air cylinder and changing valve position. Relief valve 68 is a Skinner Electric Soleonid Valve Catalog No. B2DA1175. A source of electrical power is provided by the boat battery 70. An electric switch 72 is provided for selectively completing an electric circuit from battery 70 to air pump 62 to actuate the latter to supply pressurized air to air cylinder 50, and for selectively completing an electric circuit from battery 70 to solenoid relief valve 68 to actuate the latter to depressurize air cylinder 50. Switch 72 is a Cutler Hammer switch Part No. 8946K691. Switch 72 is internally spring loaded to the center neutral position, wherein both the circuit to air pump 62 and to valve 68 are open. Switch 72 is actuated in one direction to close the circuit to air pump 62, and is actuated in the other direction to close the circuit to valve 68. The system is conveniently operated by the boat operator from the driving position.

The type of system in which the present invention is typically used is shown in U.S. Pat. No. 4,504,238, incorporated herein by reference.

It is recognized that various equivalents, alternatives, and modifications are possible within the scope of the appended claims.

What is claimed is:

1. In a stern drive marine propulsion system having an inboard engine with an exhaust and having an outboard drive unit and propeller operatively coupled to said engine and separated therefrom by a transom, an exhaust control assembly aft of said engine exhaust and forward of said transom, said assembly having an inlet connected to said engine exhaust, and having first and second outlets, valve means in said assembly for selectively controlling communication of said inlet with said first outlet, wherein said first outlet is connected to a first passage extending aft through said transom, said second outlet is connected to a second passage extending aft through said transom and through said outboard drive unit and discharging at said propeller, said valve means has a first position passing engine exhaust to said first passage, and has a second position blocking passage of engine exhaust to said first passage, and wherein said second passage is always in communication with engine exhaust at said inlet, regardless of the position of said valve means, such that said propeller is always in communication with engine exhaust.

2. The invention according to claim 1 wherein said inlet and said first outlet form a straight-through passage, and wherein said second outlet extends from the interface of said inlet and said first outlet at an angle to said straight-through passage to define a bent passage from said inlet to said second outlet.

3. The invention according to claim 2 wherein said valve means comprises a butterfly valve at the entrance to said first outlet, said butterfly valve having a first open position substantially parallel to said straight-through passage and providing communication of said inlet with said first outlet, said butterfly valve having a second closed position substantially parallel to the passage through said second outlet and providing the bend in said bent passage and deflecting exhaust from said inlet to said second outlet.

4. The invention according to claim 1 wherein said valve means comprises a plate-like disc mounted on a shaft extending through the interior of said assembly and pivotally mounted thereto, at least one end of said shaft extending exteriorly of said assembly.

5. The invention according to claim 4 comprising pneumatic actuator means on the same side of said transom as said assembly, and linkage means connected between said exterior end of said shaft and said pneumatic actuator means and responsive to the latter to pivot said shaft.

6. The invention according to claim 5 wherein said pneumatic actuator means comprises an air cylinder mounted to said assembly independently of said transom, such that said assembly and said valve means and said air cylinder are all forward of said transom, and such that the condition of said valve means is calibrated according to position and orientation of said air cylinder on said assembly independently of position and orientation relative to said transom.

7. A stern drive marine propulsion system for a boat having a transom, comprising:

an inboard engine with an exhaust;

an outboard drive unit and propeller operatively coupled to said engine and separated therefrom by said transom;

a first aperture in said transom;

a second aperture in said transom;

an exhaust control assembly aft of said engine exhaust and forward of said transom, said assembly having an inlet connected to said engine exhaust, and having first and second outlets, and valve means in said assembly for selectively controlling communication of said inlet with said first outlet;

first passage means connected to said first outlet of said assembly and extending aft through said first aperture in said transom;

second passage means connected to said second outlet of said assembly and extending aft through said second aperture in said transom to said outboard drive unit to discharge said exhaust through said outboard drive unit at said propeller, wherein said valve means has a first condition passing engine exhaust to said first passage means, and has a second condition blocking passage of engine exhaust to said first passage means, and wherein said second passage means is always in communication with engine exhaust at said inlet, regardless of the condition of said valve means, such that said propeller is always in communication with engine exhaust.

8. The invention according to claim 7 wherein:

said inlet and said first outlet of said assembly and said first passage through said first aperture in said transom form a substantially straight-through passage;

said second outlet of said assembly extends from the interface of said inlet and said first outlet of said assembly at an angle to said straight-through passage to define a bent passage from said inlet to said second outlet of said assembly.

9. The invention according to claim 8 wherein said valve means comprises:

a plate-like disc mounted on a shaft extending through the interior of said assembly and pivotally mounted thereto, at least one end of said shaft extending exteriorly of said assembly;

an air cylinder mounted to said assembly and including an extensible and retractable piston;

linkage means connected to said exterior end of said shaft and said piston to pivot said shaft in response to extension and retraction of said piston to operate said valve means between said first and second conditions.

10. A stern drive marine propulsion system for a boat having a transom, comprising:

an inboard engine with an exhaust;

an outboard drive unit operatively coupled to said engine and separated therefrom by said transom;

an exhaust control assembly aft of said engine exhaust and forward of said transom, said assembly having an inlet connected to said engine exhaust, and having first and second outlets, and a valve in said assembly having a first condition providing communication of said inlet with said first outlet, and a second condition blocking communication of said inlet with said first outlet;

first passage means connected to said first outlet and extending aft through said transom;

second passage means connected to said second outlet and extending aft through said transom;

control circuitry for said valve comprising:

an air cylinder operatively coupled to said valve for selectively controlling actuation of said valve between said first and second conditions;

an air pump for supplying pressurized air to said air cylinder;

a regulator valve for regulating the pressure supplied by said air pump to said air cylinder;

a check valve between said air pump and said air cylinder blocking back-pressure from said air cylinder to said air pump;

a relief valve for affirmatively depressurizing said air cylinder and changing the valve conditon;

a source of electrical power;

electric switch means for selectively completing an electric circuit from said source of electrical power to said air pump to actuate the latter to supply said pressurized air to said air cylinder, and for selectively completing an electric circuit from said source of electrical power to said relief valve to actuate the latter to depressurize said air cylinder.

* * * * *